US010845085B2

(12) United States Patent
Zakula et al.

(10) Patent No.: US 10,845,085 B2
(45) Date of Patent: Nov. 24, 2020

(54) ILLUMINATION GRILLE AND ASSEMBLY METHOD

(71) Applicant: Broan-NuTone LLC, Hartford, WI (US)

(72) Inventors: Mirko Zakula, New Berlin, WI (US); Kenneth J. Jonas, Mequon, WI (US); Corey Scott Jacak, West Bend, WI (US)

(73) Assignee: Broan-NuTone LLC, Hartford, WI (US)

( * ) Notice: Subject to any disclaimer, the term of this patent is extended or adjusted under 35 U.S.C. 154(b) by 165 days.

(21) Appl. No.: 15/988,406

(22) Filed: May 24, 2018

(65) Prior Publication Data

US 2018/0266722 A1 Sep. 20, 2018

Related U.S. Application Data

(63) Continuation of application No. 13/597,167, filed on Aug. 28, 2012, now Pat. No. 10,072,869.

(51) Int. Cl.
*F24F 13/078* (2006.01)
*F21V 33/00* (2006.01)

(52) U.S. Cl.
CPC ..... *F24F 13/078* (2013.01); *F21V 33/0092* (2013.01)

(58) Field of Classification Search
None
See application file for complete search history.

(56) References Cited

U.S. PATENT DOCUMENTS 3,510,228 A * 5/1970 May ..... F21V 33/00 415/121.3
4,849,862 A * 7/1989 Diskin ..... F24F 3/1603 362/96
4,926,293 A * 5/1990 Saba ..... A47L 5/38 362/149
5,255,468 A * 10/1993 Cheshire, Jr. ..... A01M 1/023 43/112
5,961,311 A * 10/1999 Moore, Jr. ..... F24C 3/103 431/6
6,150,774 A * 11/2000 Mueller ..... H05B 47/10 315/291

(Continued)

*Primary Examiner* — Avinash A Savani
*Assistant Examiner* — Martha M Becton
(74) *Attorney, Agent, or Firm* — Barnes & Thornburg LLP

(57) ABSTRACT

Embodiments of the invention provide an illumination grille assembly comprising a frame and a ventilation grille coupled to the frame, and a plurality of light-emitting diodes coupled with the frame and at least partially covered with a light transparent cover. Some embodiments of the invention provide a lighting and ventilating system including a main housing including an inlet through which air can be received within the main housing and an outlet through which the air can exit the main housing. A blower assembly can be supported in the main housing and it can be operable to generate a flow of air. In some embodiments, an illumination grille assembly can be coupled to the main housing to allow fluid to flow through the illumination grill assembly to the main housing. In some embodiments, the set of illumination devices can be configured and arranged to emit light through the light transparent cover.

20 Claims, 11 Drawing Sheets

(56) References Cited

U.S. PATENT DOCUMENTS

| | | | | |
|---|---|---|---|---|
| 6,244,720 | B1 * | 6/2001 | Neff | F21V 33/0088 362/96 |
| 7,083,659 | B1 * | 8/2006 | Joyce | F21V 33/0088 55/385.1 |
| D665,225 | S * | 8/2012 | Zakula | D7/409 |
| D681,794 | S * | 5/2013 | Lin | D23/371 |
| 8,597,389 | B2 * | 12/2013 | Ton | F21V 21/28 55/385.1 |
| 8,763,750 | B1 * | 7/2014 | Berkman | H04R 1/021 181/150 |
| D715,902 | S * | 10/2014 | Malaker | D23/262 |
| D717,408 | S * | 11/2014 | Malaker | D23/262 |
| D752,199 | S * | 3/2016 | Berkman | D23/370 |
| D752,202 | S * | 3/2016 | Berkman | D23/412 |
| 9,344,787 | B2 * | 5/2016 | Berkman | H04R 1/028 |
| 9,398,357 | B2 * | 7/2016 | Berkman | H04R 1/02 |
| 9,609,407 | B2 * | 3/2017 | Berkman | H04R 1/021 |
| 2006/0121402 | A1 * | 6/2006 | Bettinzoli | F23D 14/06 431/354 |
| 2010/0112929 | A1 * | 5/2010 | Iantorno | F24F 7/065 454/275 |
| 2010/0136897 | A1 * | 6/2010 | Lee | F24F 13/078 454/293 |
| 2014/0177900 | A1 * | 6/2014 | Berkman | H04R 1/021 381/391 |
| 2014/0177901 | A1 * | 6/2014 | Berkman | H04R 1/021 381/391 |
| 2014/0254857 | A1 * | 9/2014 | Berkman | H04R 1/028 381/395 |
| 2014/0314571 | A1 * | 10/2014 | Wu | F21V 33/0096 416/5 |
| 2017/0205082 | A1 * | 7/2017 | Kim | F24F 11/30 |

* cited by examiner

ILLUMINATION GRILLE AND ASSEMBLY METHOD

RELATED APPLICATIONS

The present application is a continuation of, and claims priority to U.S. patent application Ser. No. 13/597,167 filed Aug. 28, 2012 the entire contents of which is incorporated herein by reference.

BACKGROUND

Conventional lighting and ventilating systems can combine elements of a conventional room ventilating fan with a light fixture. These apparatuses can have a bulky, unaesthetic appearance, can employ a complicated design, can fail to adequately cool the light fixture, and/or can employ a design where the components of the apparatus are inefficiently arranged. Additionally, many conventional illumination grille assemblies can include only one illumination source which can lack certain useful functions, including a failure to provide lighting when the ventilation assembly is quiescent.

SUMMARY

Some embodiments of the invention provide an illumination grille assembly including a frame. The frame can include an aperture through which fluid can be moved. In some embodiments, the assembly can comprise at least one aperture to allow fluid to flow through the assembly. In some embodiments, a set of illumination devices can be at least partially disposed within the illumination grille assembly.

Some embodiments provide an illumination grille assembly including a grille coupled to a frame, and a plurality of light-emitting diodes coupled with the frame and substantially surrounding the grille. In some embodiments, the light-emitting diodes can be at least partially covered with a light transparent cover. In some embodiments, the illumination grille assembly can comprise at least one aperture to allow fluid to flow through the grill. In some embodiments, the lighting and ventilating assembly can allow fluid to flow through the grill, and at least one of the plurality of light-emitting diodes can emit visible light.

Some embodiments of the invention provide a lighting and ventilating system including a main housing. The main housing can include an inlet through which air can be received within the main housing and an outlet through which the air can exit the main housing. A blower assembly can be supported in the main housing and it can be operable to generate a flow of air. In some embodiments, an illumination grille assembly can be coupled to the main housing and the grill assembly can comprise at least one aperture to allow fluid to flow through the grill assembly to the main housing. In some embodiments, a set of illumination devices can be at least partially disposed within grill assembly, at least partially covered with a light transparent cover. In some embodiments, the set of illumination devices can be configured and arranged to emit light through the light transparent cover.

DETAILED DESCRIPTION

Figure 1:
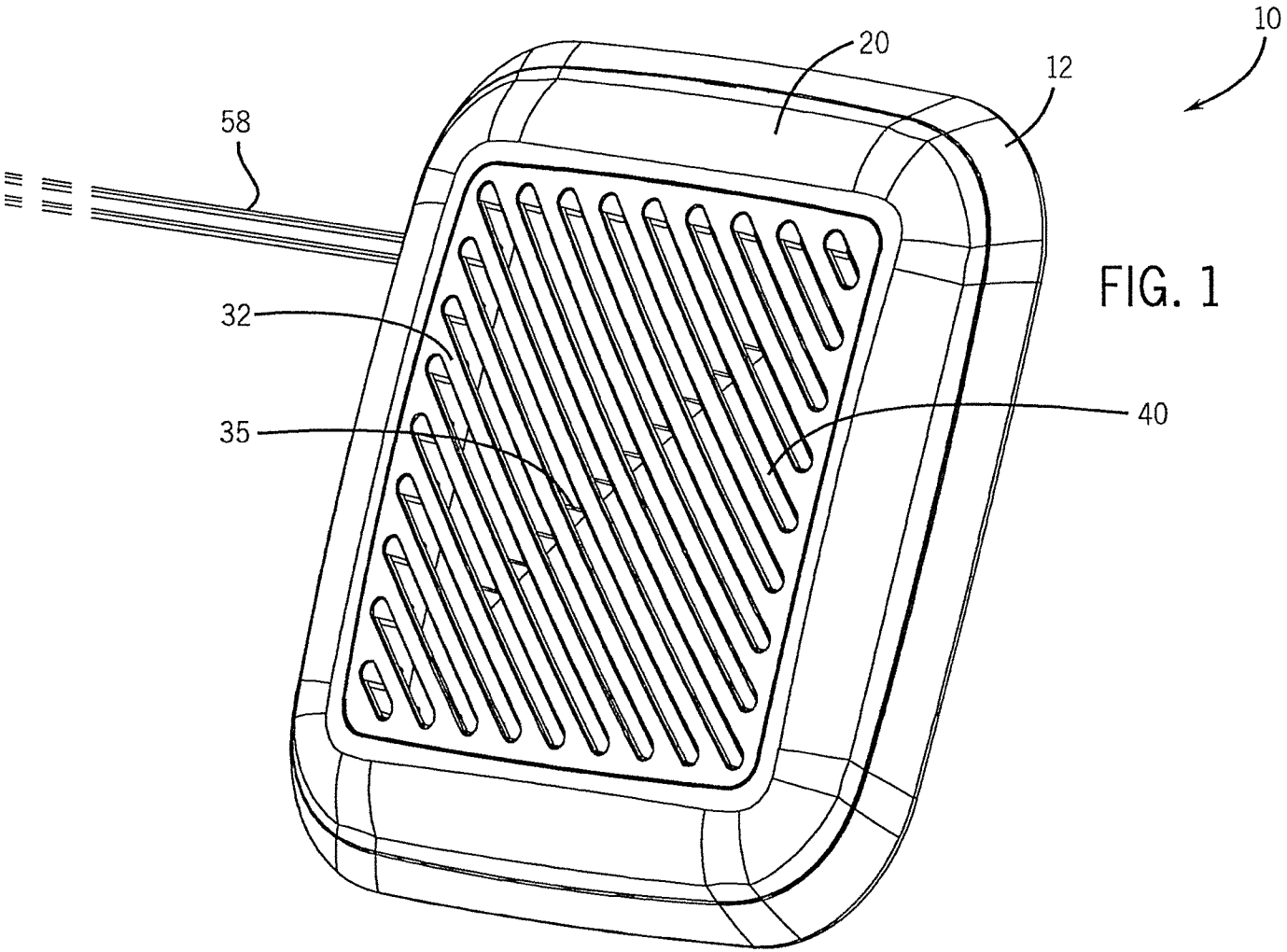
FIG. 1 is a perspective view of a portion of an illumination grille assembly according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

Figure 3:
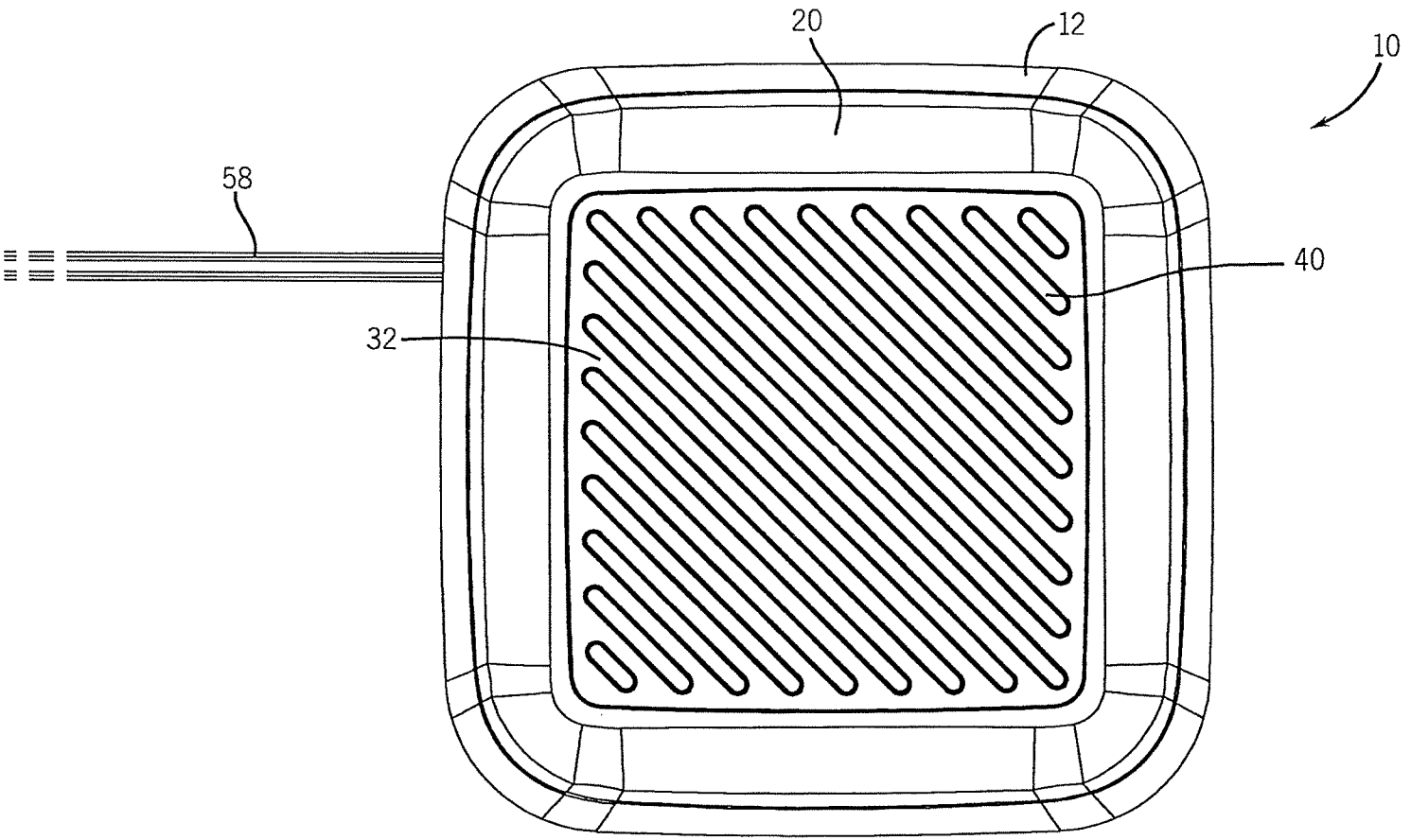
FIG. 3 is a perspective of an illumination grille assembly including a frame, and grille, and light transparent cover according to one embodiment of the invention.

FIG. 1 and FIG. 3 show a perspective view of a portion of an illumination grille assembly 10 according to one embodiment of the invention. As shown, the illumination grille assembly 10 includes a frame 12 that defines an inner portion 2 depicted as a flat vertical wall extending around the inner perimeter of the frame 12 to define a central aperture of the frame 12. The frame 12 further defines an outer portion 4 depicted as a flat vertical wall extending concentrically around the inner portion 2 and a base 6 extending between and connecting the inner portion 2 and outer portion 4 to define a channel 8 which extends around the central aperture. A light transparent cover 20 is coupled to the frame 12 over the top of the channel 8. A ventilation grille 32 is coupled to the frame 12 and the light transparent cover 20, and is positioned at least partially within the central aperture of the frame 12. In some embodiments, the central aperture is not centered in the frame 12.

Figure 11:
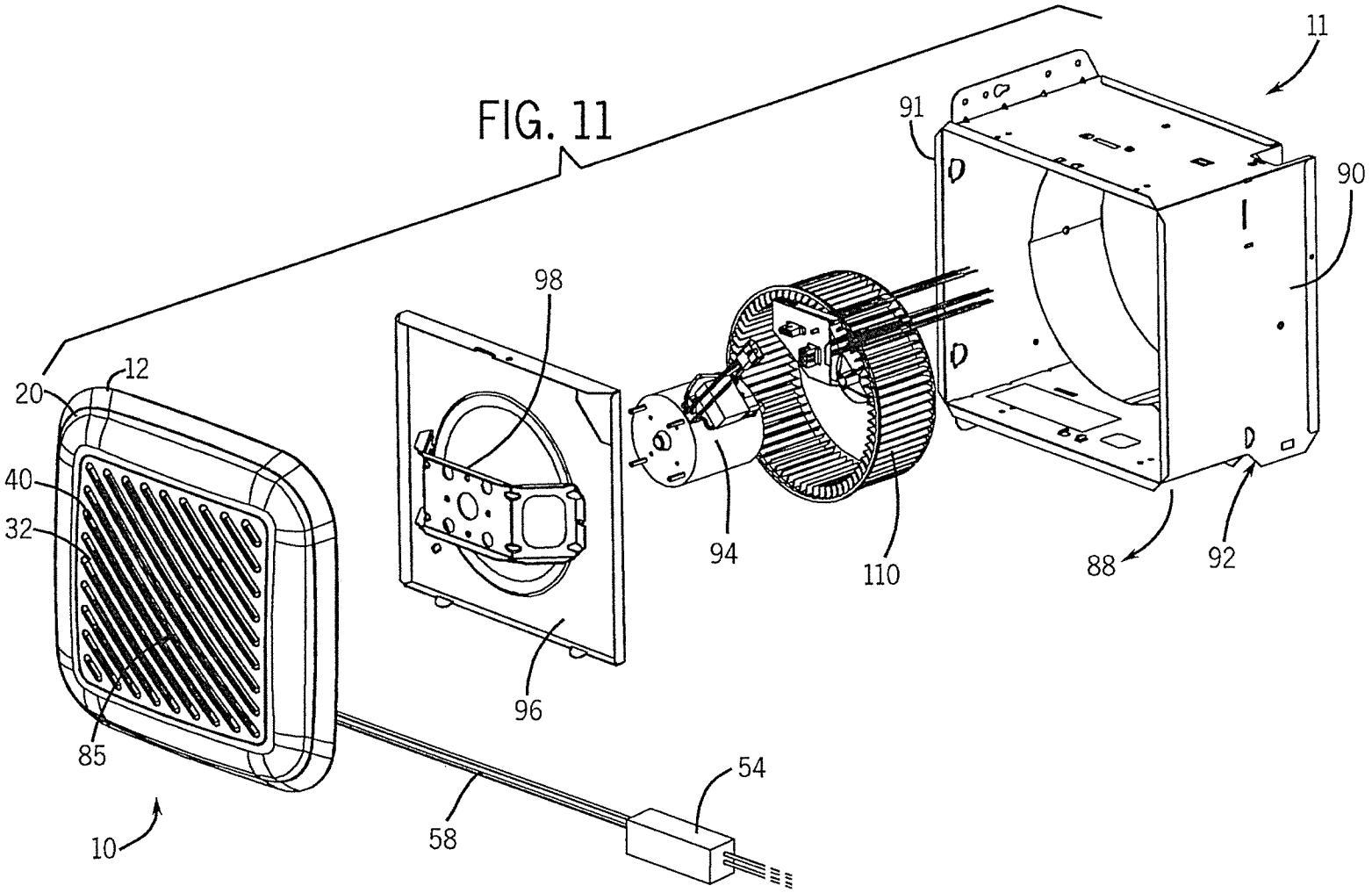
FIG. 11 is an exploded view of an illumination grille assembly according to one embodiment of the invention.

As shown in FIGS. 1-6, in some embodiments, the ventilation grille 32 can include one or more grille apertures 40. In some embodiments, the grille apertures 40 can extend across the ventilation grille 32. The grille apertures 40 can be used for receiving a flow of air. The plurality of grille apertures 40 can be located anywhere on the ventilation grille 32. In some embodiments, the location of the grille apertures 40 can be at least partially determined by airflow path(s) which can be available. In some embodiments, the dimensions and configurations of the grille apertures 40 may be a function of the configuration of the main housing 90 (shown in FIG. 11). The illumination grille assembly 10 defines and interior side 11 configured to face the main housing 90 and an exterior side 13 facing a room in which the illumination grille assembly 10 is installed. In some embodiments, the grille apertures 40 can be located substantially within a central region of the ventilation grille 32. In some embodiments, the grille apertures 40 can be selected substantially based on aesthetics, functionality, and other considerations that can be important to a user and/or a manufacturer. In some embodiments, the grille apertures 40 can guide fluid into the ventilation and lighting assembly 10 and the system 11 (shown in FIG. 11). The fluid can include air, moisture, steam, exhaust, smoke, effluent, or anything similar. In some embodiments, after passing through the grille apertures 40 and entering the main housing 90, the fluid can exit the lighting and ventilating system 11 as discussed below. In some embodiments, the lighting and ventilating system 11 as depicted in FIG. 11 can be operable to discharge the airflow to another location, such as an attic, outside of the structure in which the system 11 can be secured, and/or to a conventional duct network.

In some embodiments, the illumination grille assembly 10 includes components of a light engine. For example, the power leads 58 shown in FIG. 1 and FIG. 3 are connected to components of a light engine. For example, as depicted in FIG. 2, which shows a perspective view of illumination grille assembly 10 according to one embodiment of the invention, the illumination grille assembly 10 can include a power module 54, a plug 56, and a power lead 58 connecting the plug 56 to the power module 54, and the power module 54 to a component of the illumination grille assembly 10 (not shown).

Figure 2:
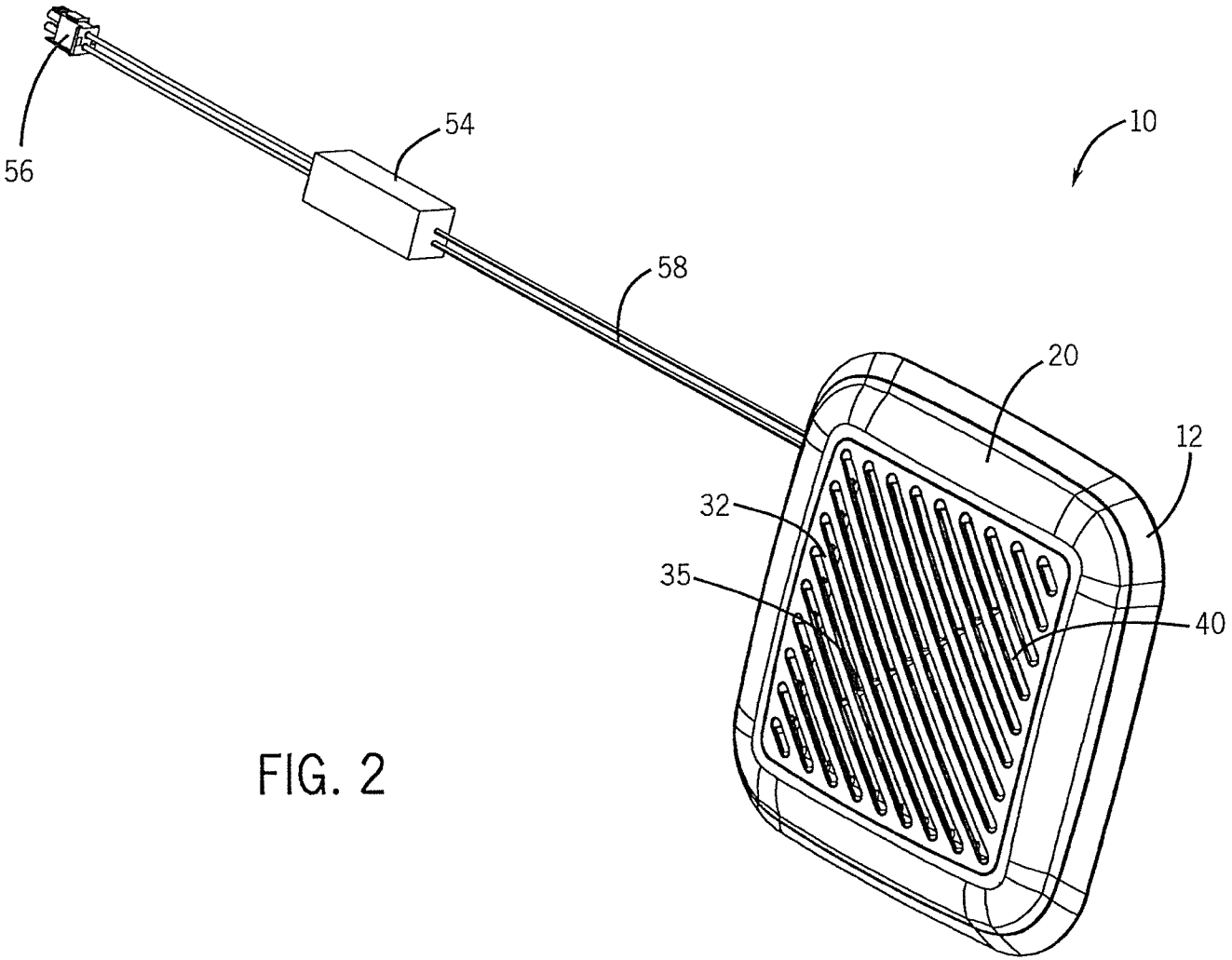
FIG. 2 is a perspective view of an illumination grille assembly according to one embodiment of the invention.

Referring to FIG. 2 and FIG. 3, in some embodiments, portions of the illumination grille assembly 10 can define the outer edges of the assembly 10 to include substantially curved areas. Substantially curved areas can include arched, arced, angled, bent, bowed, curled, rounded, warped, or any other deviation from substantially planar. In other embodiments, the portions of the illumination grille assembly 10 which can define the outer edges of the assembly 10 can be substantially planar or square. In some embodiments where the central portion of the ventilation grille 32 can be elevated with respect to the outer edges of the assembly 10, the substantially curved area of the outer edges of the assembly 10 can curve in a generally upward direction. More specifically, the central portion of the ventilation grille 32 can reside as a plateau coupled to the outer edges of the ventilation grille 32 but on a different horizontal plane with the substantially curved area of the outer edges of the assembly 10. In some embodiments where the central portion of the ventilation grille 32 can be can be recessed with respect to the outer edges of the assembly 10, the substantially curved area of the outer edges of the assembly 10 can curve in a generally downward direction.

Figure 4:
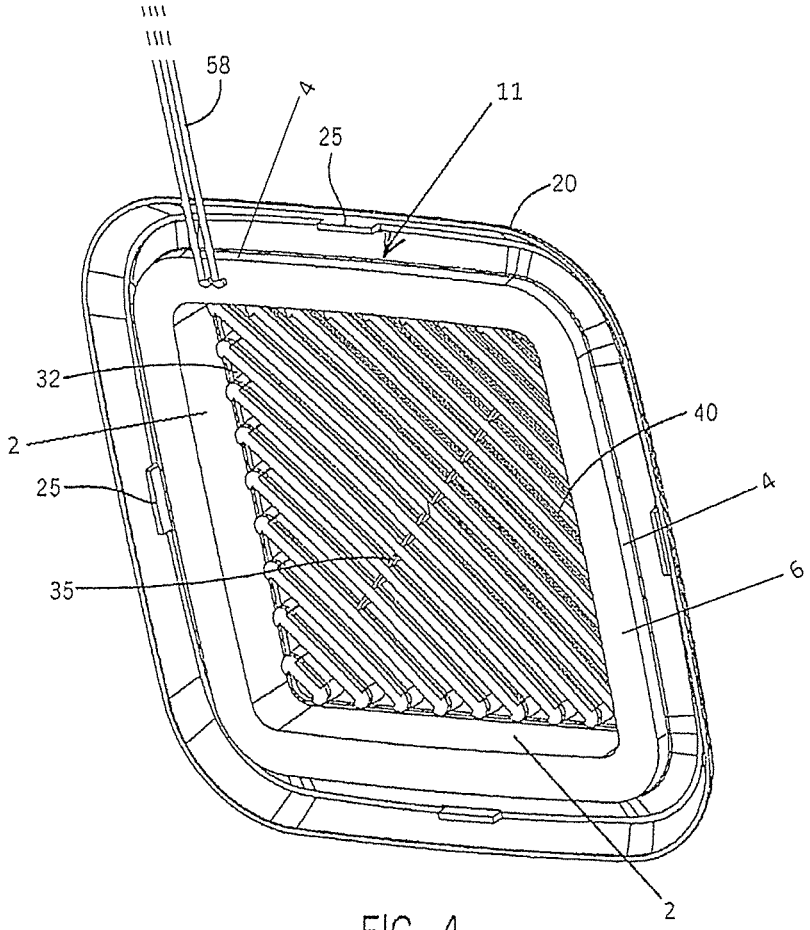
FIG. 4 is a rear perspective view of an illumination grille assembly including a frame, and grille, and light transparent cover according to one embodiment of the invention.

FIG. 3 is a perspective top view of an illumination grille assembly including a frame, and grille, and light transparent cover 20. FIG. 4 is a rear perspective view of an illumination grille assembly 10 including a frame 12, and grille 32, and a light transparent cover 20 according to one embodiment of the invention. As shown in FIG. 4, in some embodiments, the light transparent cover 20 can comprise different configurations. In some embodiments, the light transparent cover 20 can comprise at least one tab 25. In some embodiments, the light transparent cover 20 can comprise a plurality of tabs 25. In some embodiments, at least a portion of the tabs 25 can be used to couple the light transparent cover 20 to the frame 12 using one or more tab receptacles 15, formed substantially with the frame 12. Furthermore, in some embodiments, at least a portion of the tabs 25 can be substantially integral with the light transparent cover 20. For example, in some embodiments, the light transparent cover 20 can comprise a single sheet of material, such as a polymer material, and the tab 25 and can be formed so that the light transparent cover 20 and the tab 25 are a monolithic structure. Moreover, in some embodiments, the ventilation grille 32 can be formed in a mold so that the tabs 25 can be formed into a monolithic structure at the same time. Similarly, in some embodiments, the frame 12 can comprise a single sheet of material, such as a polymer material, and the tab receptacle 15 and can be formed so that the frame and the tab receptacle 15 are a monolithic structure. In some embodiments, in order of the frame 12 to be coupled with the light transparent cover 20, the tab receptacle 15 can comprise a component separate from the frame 12 (not shown) that is attached to the frame, configured and arranged to receive a tab 25 of the light transparent cover 20.

In some embodiments, the horizontal plane of the ventilation grille 32 can be substantially parallel to the horizontal plane of the light transparent cover 20, but the two horizontal planes need not be congruent. More specifically, in some embodiments, the horizontal plane of the ventilation grille 32 can be generally elevated with respect to the light transparent cover 20. In other embodiments, the ventilation grille 32 can be generally recessed with respect to the transparent cover 20. In other embodiments, the horizontal planes of both the ventilation grille 32 and the transparent cover 20 can be substantially congruent so that the entire external surface of the illumination grille assembly 10 can be generally planar.

As shown, the illumination grille assembly 10 is generally square, however in other embodiments, the illumination grille assembly 10 may be substantially rectangular. In other embodiments, the illumination grille assembly 10 may be substantially circular, or substantially oval, whereas in other embodiments, illumination grille assembly 10 may be substantially triangular. In some other embodiments, the illumination grille assembly 10 may comprise other shapes, such as, but not limited to square, rectangular, regular or irregular polygonal, or any shape generally corresponding to the main housing 90, etc. The ventilation grille 32 may be formed from any material that is readily shaped, including, but not limited to, polymers, including injection-molded or thermo-formed polymeric materials, polymer-composites, metal, ceramic, or wood, or paper-based composite or laminate. Furthermore, the use of injection-molded or thermo-formed polymeric materials conveniently allows a variety of functional components to be included into the structure of the ventilation grille 32, such as one or more tabs 25. In some embodiments the ventilation grille 32 is formed from a sheet metal, including, but not limited to an aluminum-based metal, a steel or iron-based metal, a zinc-based metal, or a nickel and tin-based metal.

In some embodiments, the ventilation grille 32 and the light transparent cover 20 can be formed from at least two different subunits and coupled together. The ventilation grille 32 and the light transparent cover 20 can be coupled using any of the methods described above. In some embodiments, at least a portion of the ventilation grille 32 can be completely or substantially integral with the light transparent cover 20. For example, in some embodiments, the light transparent cover 20 can comprise a single sheet of material, such as a polymer material, and the ventilation grille 32 and can be formed so that the light transparent cover 20 and the ventilation grille 32 are a monolithic structure. For example, in some embodiments, the light transparent cover 20 and the ventilation grille 32 can be injection-molded to form a single monolithic structure. Moreover, in some embodiments, the ventilation grille 32 can be formed in a mold, such as a thermosetting mold, so that the light transparent cover 20 and the ventilation grille 32 can be injection-molded at the same time to form a single monolithic structure.

As shown in FIG. 4, in some embodiments, the ventilation grille 32 can comprise at least one cross-rib 35. The cross-rib 35 can couple with one or more of the grille apertures 40. In some embodiments, the cross-rib 35 can couple with one or more of the grille apertures 40 to provide mechanical strength to the ventilation grille 32. In some embodiments, the cross-rib 35 can couple with one or more of the grille apertures 40 based on aesthetics, functionality, and other considerations that can be important to a user and/or a manufacturer. In some embodiments, at least one cross-rib 35 can couple with one or more of the grille apertures 40 to guide fluid into the ventilation and lighting assembly 10 and the system 11. In some embodiments, the ventilation grille 32 and the cross-rib 35 can be formed from at least two different subunits and coupled together. The ventilation grille 32 and the cross-rib 35 can be coupled using any of the methods described above. In some embodiments, at least a portion of the ventilation grille 32 can be substantially integral with the cross-rib 35. For example, in some embodiments, the cross-rib 35 can comprise a single body of material, such as a polymer material, and the ventilation grille 32 and can be formed so that the cross-rib 35 and the ventilation grille 32 are a monolithic structure. For example, in some embodiments, the cross-rib 35 and the ventilation grille 32 can be injection-molded to form a single monolithic structure. Moreover, in some embodiments, the ventilation grille 32 can be formed in a mold, such as a thermosetting mold, so that the cross-rib 35 and the ventilation grille 32 can be injection-molded at the same time to form a single monolithic structure.

In some embodiments, the cross-rib 35 may be formed from the same materials as the ventilation grille 32. In some embodiments, the cross-rib 35 may be formed from any material that is readily shaped, including, but not limited to, polymers, including injection-molded or thermo-formed polymeric materials, polymer-composites, metal, ceramic, or wood, or paper-based composite or laminate. Furthermore, the use of injection-molded or thermo-formed polymeric materials conveniently allows the cross-rib 35 to be included into the structure of the ventilation grille 32 as described above. In some embodiments the cross-rib 35 is formed from a sheet metal, including, but not limited to an aluminum-based metal, a steel or iron-based metal, a zinc-based metal, or a nickel and tin-based metal. In some embodiments, the cross-rib 35 can extend across the ventilation grille 32. In some other embodiments, the cross-rib 35 may extend only partially across the grille 32. In some embodiments, a plurality of cross-ribs 35 can be located anywhere on the ventilation grille 32. In some embodiments, the location of the cross-rib 35 can be at least partially determined by airflow path(s) which can be available.

Figure 5:
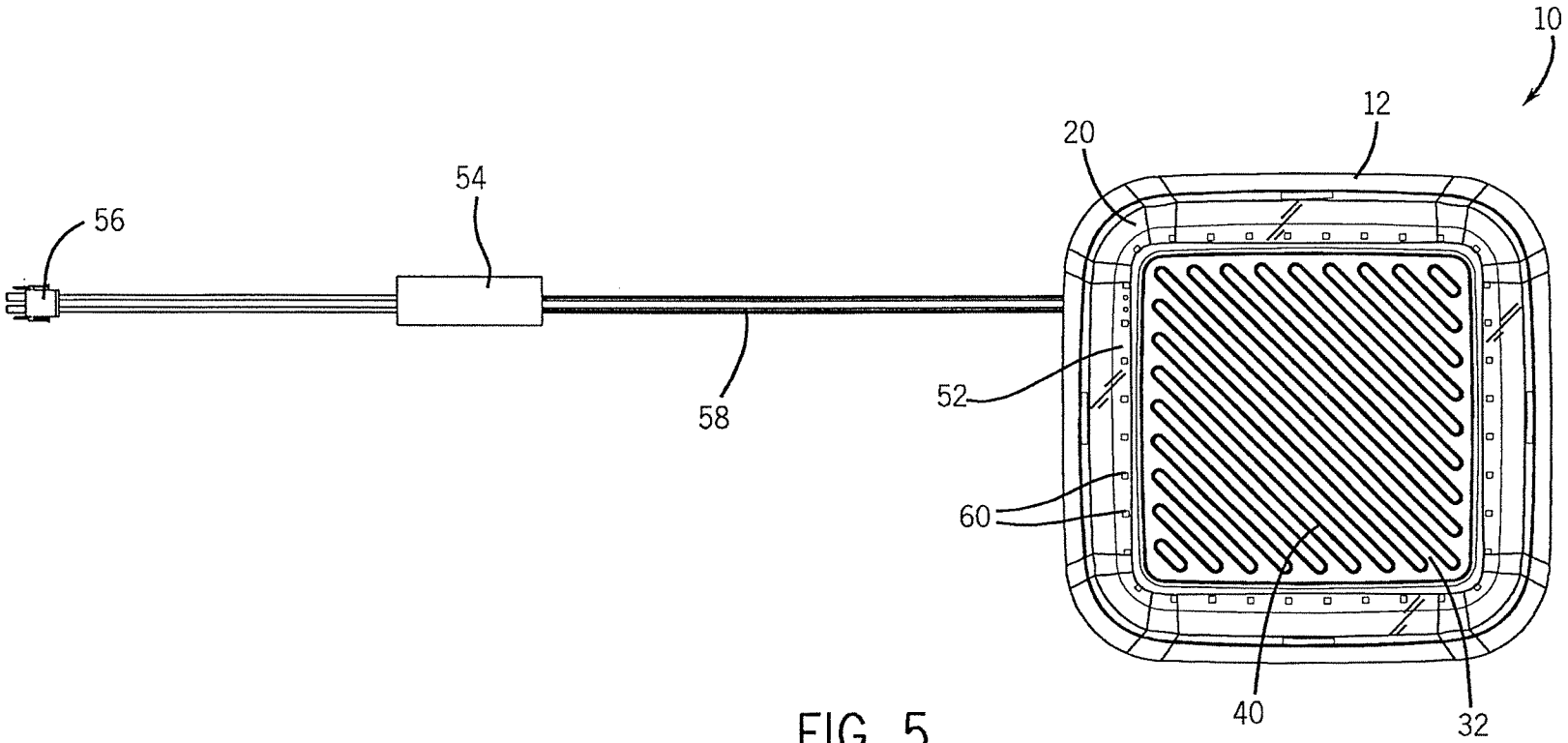
FIG. 5 is a perspective view of an illumination grille assembly according to one embodiment of the invention.
Figure 6:
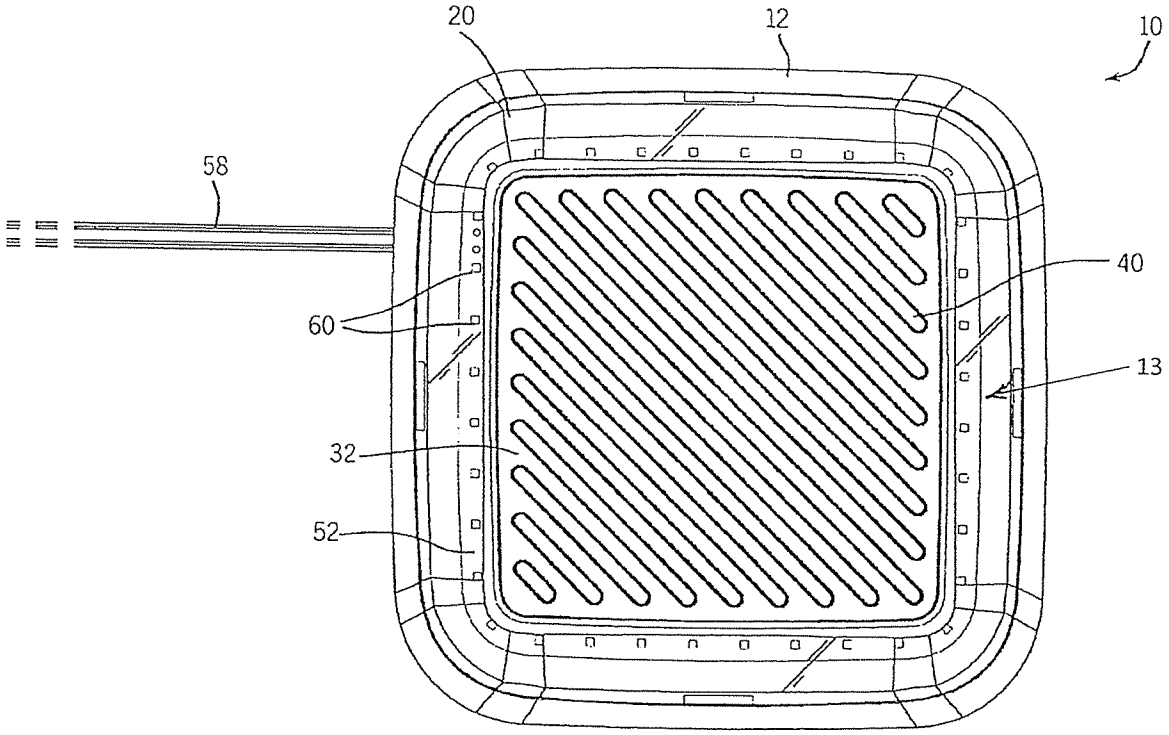
FIG. 6 is a perspective view of an illumination grille assembly, with a light transparent cover showing a printed circuit board and plurality of light emitting diodes according to one embodiment of the invention.
Figure 7:
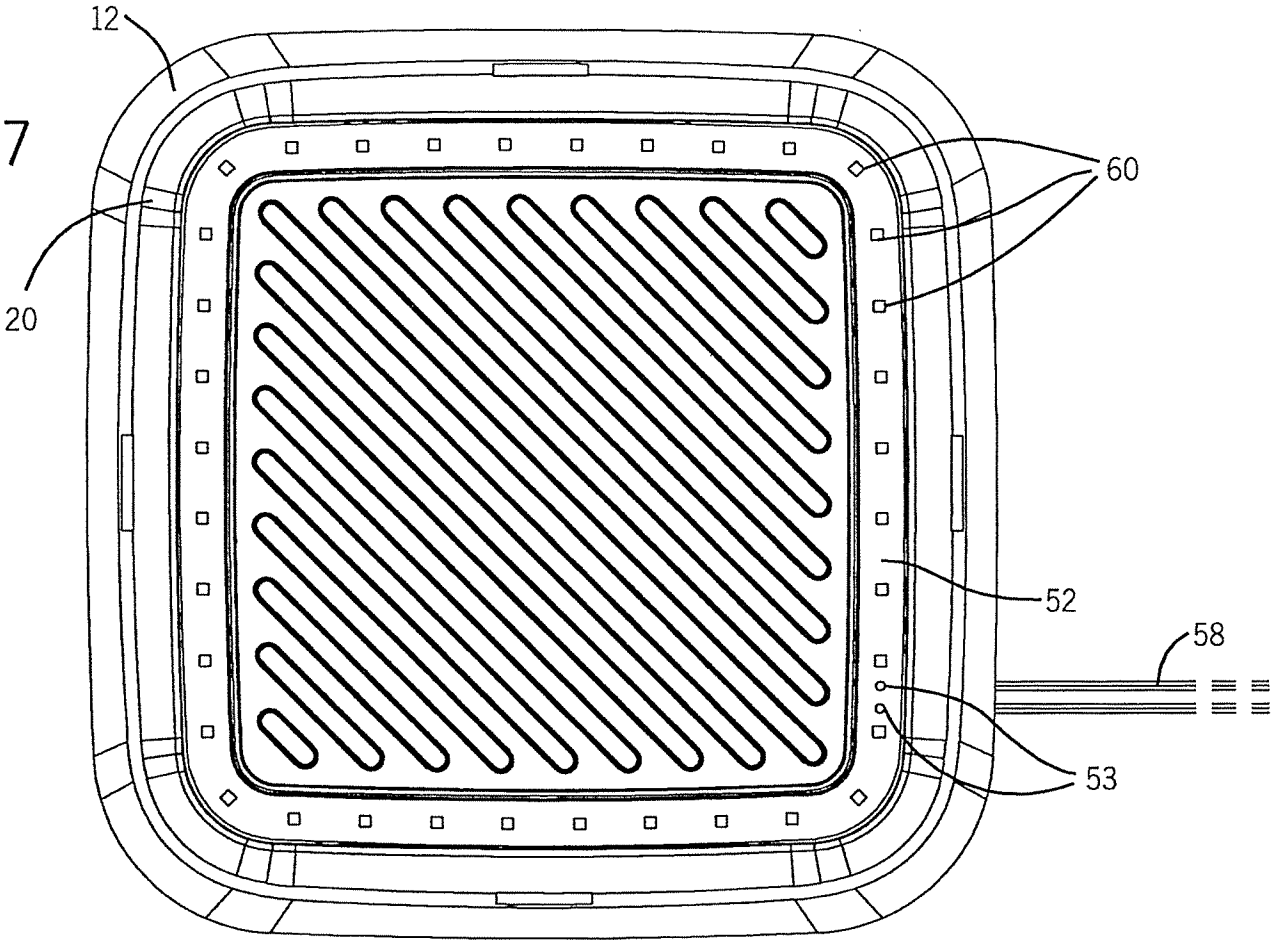
FIG. 7 is an illustration of an illumination grille assembly frame, with a light transparent cover showing a printed circuit board and plurality of light emitting diodes according to one embodiment of the invention.
Figure 8:
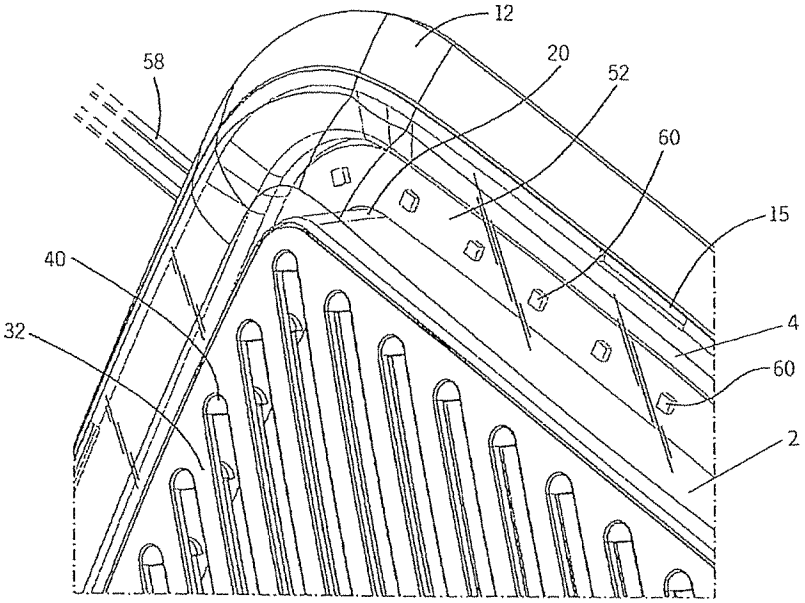
FIG. 8 shows a close-up perspective view of an illumination grille assembly showing a frame with a light transparent cover, a printed circuit board and plurality of light emitting diodes according to one embodiment of the invention.
Figure 10B:
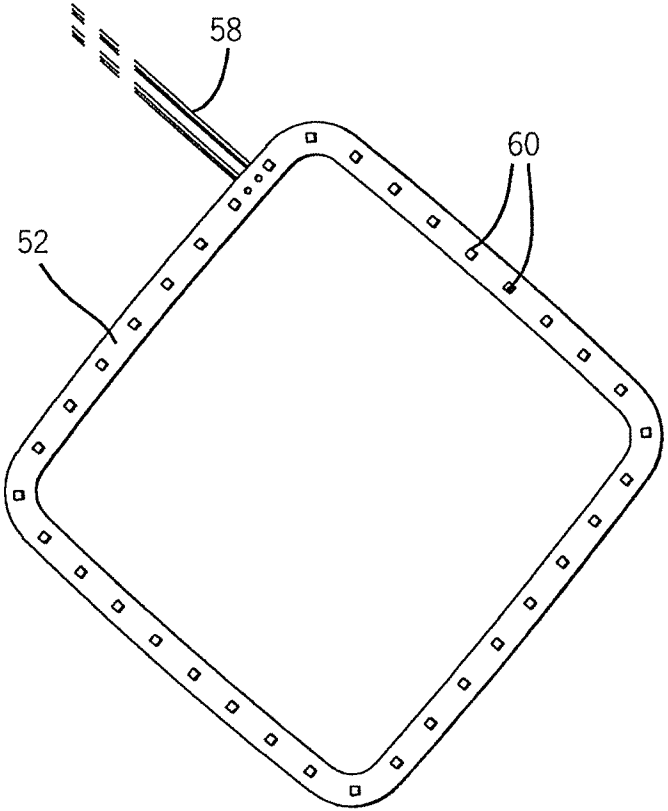
FIG. 10*b* shows a perspective view of a light emitting diode light engine printed circuit board of an illumination grille assembly according to one embodiment of the invention.
Figure 10A:
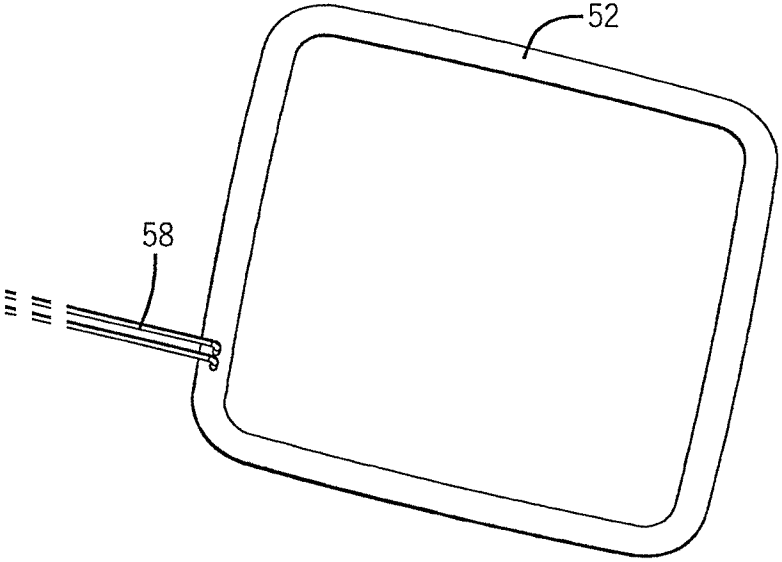
FIG. 10*a* shows a perspective view of a light emitting diode light engine printed circuit board of an illumination grille assembly according to one embodiment of the invention.

FIG. 5 is a perspective view of an illumination grille assembly according to one embodiment of the invention wherein components of a light engine are shown, comprising a printed-circuit board 52, electrical sockets 53, power module 54, plug 56, power lead 58, and a plurality of light emitting diodes 60. These components can also be viewed in the perspective views of FIG. 6 and FIG. 7, as well as the close-up view perspective view of an illumination grille assembly 10 in FIG. 8, showing a partially transparent light transparent cover showing a printed circuit board and plurality of light emitting diodes according to one embodiment of the invention. Furthermore, FIG. 10 shows a perspective view of a light emitting diode 60 light engine printed circuit board 52 of an illumination grille assembly 10 according to one embodiment of the invention. As shown, in some embodiments, the printed circuit board 52 can include the electrical sockets 53, and a plurality of light emitting diodes 60. In some embodiments, the electrical sockets 53 can be connected to the light emitting diodes 60. The light emitting diodes 60 can contact the electric sockets 53, and, in some embodiments, when activated by the user, the light emitting diodes 60 can provide illumination to the room, area, or space. In some embodiments, the light emitting diodes 60 can include incandescent, fluorescent, compact fluorescent, halogen, and other lights and lamps. Further, these lights can be flood lights, globe lights, light-emitting diodes, or other similar lighting apparatuses, including a combination of any of the above.

In some embodiments of the invention, the illumination emitted by the light emitting diodes 60 can comprise a range of colored illumination. The color can be any color, include red, green blue, green, purple, amber, yellow, or any other color. Further, in some embodiments, the range of colored illumination can include variations in hues of the same color. In some embodiments, the light emitting diodes 60 can be configured to operate separately from one another. In some embodiments, a first set of light emitting diodes 60 can be configured to emit either a brighter or duller light than the remainder of the light emitting diodes 60. Also, in some embodiments, the light emitting diodes 60 can be configured in any conventional manner to have one or more dimmed settings or can be controllable in a range of brightness.

In some embodiments, the illumination grille assembly 10 can include the capability to emit visible light of substantially a single color. In some embodiments, the assembly 10 can include the capability to emit more than one color. In some embodiments, the user can select which color he or she prefers for the dynamic illumination event from any color that the assembly 10 can display. In some embodiments, the assembly 10 can include four colors from which the user can chose, although in other embodiments, the system can include any number of colors that the manufacturer or user desires. In some embodiments, the user can use a selection actuator (not shown) to select the color of the dynamic illumination event. In some embodiments, the selection actuator can be a dip switch, but in other embodiments, the selection actuator can be a rotary switch, or any other suitable device (not shown). In some embodiments, the selection actuator can be positioned substantially within the assembly 10, the main housing 90, the ventilation grille 32, or generally anywhere in or on the system 11, but in other embodiments, the selection actuator can be installed in a remote location.

Figure 9B:
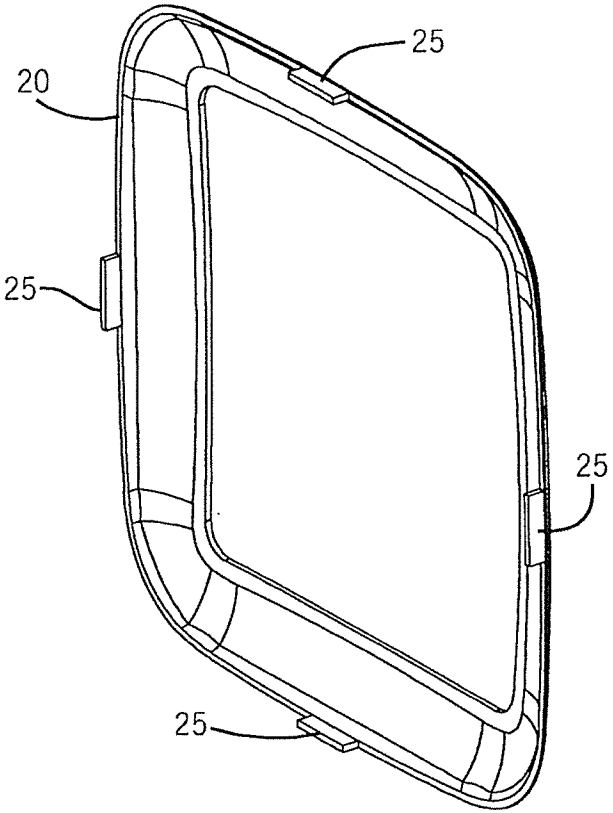
FIG. 9*b* shows a perspective view of a light transparent cover of an illumination grille assembly according to one embodiment of the invention.
Figure 9A:
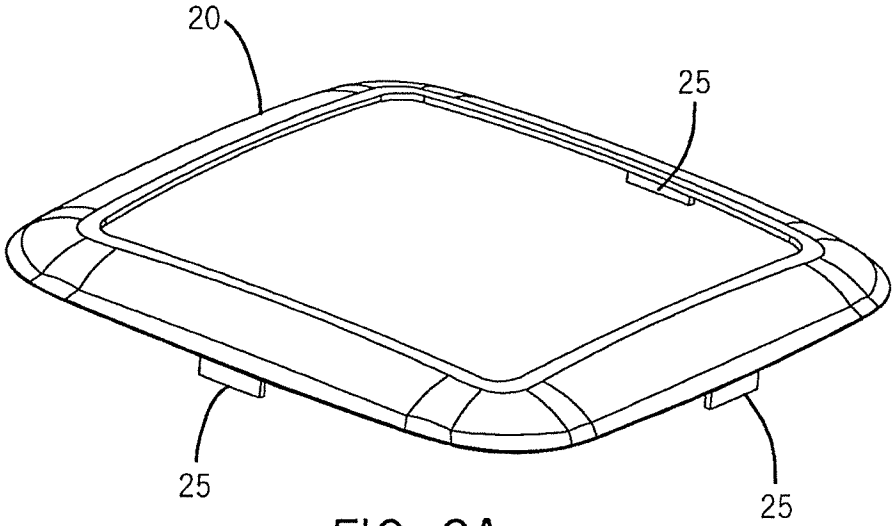
FIG. 9*a* shows a perspective view of a light transparent cover of an illumination grille assembly according to one embodiment of the invention.

FIG. 9*a* and FIG. 9*b* shows a perspective view of a light transparent cover 20 of an illumination grille assembly 10 according to one embodiment of the invention. In some embodiments, the light transparent cover 20 can be formed from glass, acrylic, injection-molded polymers, or any other similar material. In some embodiments, the light transparent cover 20 can be formed such that it is substantially transparent. In other embodiments, the plate can be formed such that it can be substantially translucent, opaque, or any other light-transmissive state within the range of any of the above. Further, in some embodiments, the light transparent cover 20 can include different regions which can include different light-transmissive properties. In some embodiments, the light transparent cover 20 can be generally colorless (i.e., lacking all tint). In other embodiments, the light transparent cover 20 can include a tint. Further, in some embodiments the tint color can include green, blue, red, orange, violet, yellow, or any other color or combination of colors (not shown). In some embodiments, the light transparent cover 20 can include a substantially non-textured or smooth surface. In other embodiments, the light transparent cover 20 can include a non-homogenous surface so that the surface of the light transparent cover 20 can at least partially textured. In some other embodiments, the light-transparent cover 20 comprises a material capable of scattering light. For example, in some embodiments, at least a partial area of the surface or layers of the light-transparent cover 20 can comprise a material capable of scattering light. In other embodiments, at least a partial region of the bulk of the structure of the light-transparent cover 20 can comprise a material capable of scattering light. In some embodiments, the light transparent cover 20 can be manufactured as a single unit. In some embodiments, the light transparent cover 20 can be manufactured as multiple units and those multiple units can be coupled using any one or combination of the coupling techniques discussed above.

As shown in FIGS. 5, 6, 7, 8, and 10*b*, in some embodiments, plurality of LEDs. 60 can be substantially equally spaced. In other embodiments, the plurality of light emitting diodes 60 may have unequal spacing, or may be arranged in groups of two or more. In some embodiments, each light emitting diode 60 may be a single light emitting diode 60, and in other embodiments, each light emitting diode 60 may comprise more than one light emitting diode 60 (e.g a plurality of light emitting diodes 60 arranged as one unit). In some embodiments, isolated light emitting diodes 60 may be replaced by a ribbon of light emitting diodes 60 to provide the user with the impression of a single continuous strip of illumination. Further, the ribbon of light emitting diode 60 can comprise flood lights, globe lights, light emitting diodes, or other similar lighting apparatuses, including a combination of any of the above. In some embodiments, electrical connections can be coupled to the ribbon of light emitting diodes 60 so that the ribbon of light emitting diodes 60 can receive power. In some embodiments, the electrical connections can be part of a larger network of electrical components that can be connected to a user interface with which the user can use to control the system 11. In some embodiments of the invention, the second set of light emitting diodes 60 can be configured to operate independently of the first set of light emitting diodes 60. In some embodiments, the second set of light emitting diode 60 can be configured to substantially automatically emit illumination when the area around the system 10 substantially lacks illumination (e.g., operate as a "night light").

In some embodiments, the plurality of light emitting diodes 60 can provide illumination both when the user is and/or is not in the space to be illuminated. For example, in some embodiments, when the user is not present in the space to be illuminated, the plurality of light emitting diodes 60 can emit a generally low-level intensity of illumination so that the system 11 can function as a night light, similar to some of the previously mentioned embodiments. In some embodiments, this can be controlled, at least partially, by the motion-sensing monitor (e.g. the system 11 can function as a night light when there is little to no movement in the space). Additionally, in some embodiments, a plurality of light emitting diodes 60 can be controlled by a timer to determine when the low-intensity illumination should be emitted. In some embodiments, upon detecting the presence of the user (e.g., via the motion-sensing monitor, a user-actuated switch, and/or a timer), the plurality of light emitting diodes 60 can emit the dynamic illumination event or can substantially immediately begin emitting a greater intensity illumination so that at least a portion of the room is substantially illuminated (e.g., the system 11 can provide both quiescent and/or task illumination).

In some embodiments, at least a portion of the printed circuit board 52 immediately in the region of one or more of the light emitting diodes 60 can comprise a substantially reflective surface. As a result, in some embodiments, at least a portion of the illumination provided by the light emitting diode 60 can be centrally reflected by the reflective surface to improve the illumination performance of the light emitting diode 60, and the illumination grille assembly 10.

FIG. 11 is an exploded view of an illumination grille assembly according to one embodiment of the invention. Some embodiments of the system 11 can include several components and devices that can perform various functions. In some embodiments of the present invention, the lighting and ventilating system 11 can include an illumination grille assembly 10. In some embodiments, the lighting and ventilating system 11 can include a main housing 90, which can house components of the system 11. The main housing 90 can generally include a motor plate 96 and a motor 94 coupled to the motor plate 96, and a blower assembly including a blower wheel 110 coupled to the motor 94, and a ventilation outlet 92. In some embodiments, the system 11 can include the motor 94 connected to the motor plate 96 by a bracket 98. The motor 94 can include a motor shaft, which can extend through the bracket 96 and/or the motor plate 74 to produce ventilating airflow. In some embodiments, the assembly 11 can be removeably connected within the main housing 90 as a single integral unit. The housing 90 can include a mounting apparatus (not shown). In other embodiments, the main housing 90 can be coupled to a support structure using the mounting, or using a variety of fasteners and other conventional coupling methods (not shown).

As evident from the exploded view of FIG. 11, in some embodiments, the lighting and ventilating assembly 10 can be positioned within an open end of the main housing 90. In some embodiments, the main housing 90 can include one or more lips, flared edges, flanges 91, or other features to which the lighting and ventilating assembly 10 be can coupled. In some embodiments, the main housing 90 can include a first set of peripheral flanges 91 to which the lighting and ventilating assembly 10 can be coupled. In other embodiments, the lighting and ventilating assembly 10 can be shaped and dimensioned to be received within the main housing 90 and the lighting and ventilating assembly 10 can be coupled to the main housing. In some embodiments, one or more snap-fit features can be provided (not shown) to secure the lighting and ventilating assembly 10 to the main housing 90. In some other embodiments, the snap-fit features may be replaced by any variety of couplings, such as screws, grille springs, bolts, rivets, pins, clamps, glue or other adhesive, and any other similar coupling. In some embodiments, the main housing 90 and the lighting and ventilating assembly 10 can be further secured through other coupling practices such as welding, soldering, brazing, adhesive or cohesive bonding material, any combination of the foregoing, or any other similar coupling practice.

In some embodiments, the illumination grille assembly 10 can be couple with the main housing 90, and power can be supplied to the motor 94 of a magnitude to turn the blower wheel 110, thereby providing a glow fluid to the ventilation outlet 92 (depicted as fluid output 88 in FIG. 11). In some embodiments, fluid can pass through the lighting and ventilating assembly 10, by passing through one or more grille apertures 40 (depicted as fluid 85). In some embodiments, after the fluid flows through the one or more grille apertures 40, the fluid passes into the blower wheel and subsequently passes out of the main housing 90 through the ventilation outlet 92.

In some embodiments, the illumination grille assembly 11 can be secured within a wall, ceiling, or other building structure in a partially, or fully recessed position. In some embodiments, the illumination grille assembly 11 can be installed as a new, original equipment installation in a room or building where none had previously existed, whereas some embodiments of the invention provide an illumination grille assembly 11 that can replace a pre-existing ventilation system, or pre-existing ventilation grille assembly. In some embodiments, the illumination grille assembly 11 can be installed within an intermediate space, outside of the room, area or space, and coupled with one or more ventilation duct assemblies to provide ventilation to the room, area or space. In some other embodiments, the fluid may comprise air, or other gases, or vapor, such as water vapor. In some embodiments, the fluid may comprise a smoke, ash, or other particulate in addition to air or other gases.

In some embodiments, one or more power consuming devices, including, but not limited to the motor 94 and the light emitting diode 60 can be powered by an internal electrical circuit of a building. In some embodiments, one common line from one side of the main housing 90 can provide an inlet for one or more lines of power to enter the main housing 90 and power one or more of the power-consuming devices.

In some embodiments, one or more switches, such as wall switches can be used to activate or deactivate any of the power-consuming devices of the illumination grille assembly 10, and the system 11. In some embodiments, separate switches can be used to control the illumination characteristics of the illumination grille assembly 10, and the ventilating characteristics of the assembly 11. In some embodiments, one switch can be used to control both the illumination characteristics of the illumination grille assembly 10 and the ventilating characteristics of the assembly 11.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. An illumination grille assembly, comprising:

a frame having an exterior side and an interior side and having an inner portion, the inner portion defining a central aperture;

a ventilation grill defining at least one grille aperture positioned at least partially within the central aperture and configured and arranged to permit airflow through the at least one grille aperture;

the frame further having an outer portion arranged around the inner portion and a base extending between and connecting the inner portion and the outer portion such that the exterior side of the inner portion together with the base and outer portion define a channel surrounding, and adjacent to, the central aperture and wherein the inner portion separates air flow through the grille from the channel;

a plurality of light-emitting diodes on a printed circuit board within the channel; and a cover coupled to the exterior side of the frame and positioned at least partially covering at least one of the plurality of light-emitting diodes.

2. The illumination grille assembly of claim 1, wherein the frame and the cover are distinct components.

3. The illumination grille assembly of claim 1 further comprising a light engine, the light engine comprising a printed circuit board, a power module and at least one plug, wherein the printed circuit board is configured and arranged to mount at least one of the plurality of light-emitting diodes.

4. The illumination grille assembly of claim 2 further comprising a light engine, the light engine comprising a printed circuit board, a power module and at least one plug, wherein the printed circuit board is configured and arranged to mount at least one of the plurality of light-emitting diodes.

5. The illumination grille assembly of claim 1, wherein the cover comprises a lens.

6. The illumination grille assembly of claim 1, wherein at least a portion of the cover includes a tint.

7. The illumination grille assembly of claim 1, wherein the cover comprises a light scattering material.

8. The illumination grille assembly of claim 1, wherein at least one of the plurality of light-emitting diodes is configured and arranged to radiate at least white light.

9. The illumination grille assembly of claim 1, wherein at least one of the plurality of light-emitting diodes is configured and arranged to radiate at least one of red light, green light, blue light, yellow light, and amber light.

10. The illumination grille assembly of claim 4, wherein the light engine is configured and arranged to radiate different intensities of illumination.

11. The illumination grille assembly of claim 1, wherein at least one of the plurality of light-emitting diodes is configured and arranged to radiate light of difference wavelengths.

12. The illumination grille assembly of claim 1, the inner portion is comprised of a flat vertical wall.

13. The illumination grille assembly of claim 1, the inner portion is comprised of a flat vertical wall and the outer portion is comprised of a flat vertical wall.

14. The illumination grille assembly of claim 1, wherein the cover is light-transparent.

15. A ventilation assembly, comprising:

a main housing, the main housing having a plurality of walls defining an interior space;

a blower assembly, the blower assembly comprising a motor, and a blower wheel coupled to the motor;

a frame having an exterior side and an interior side and having an inner portion, the inner portion defining a central aperture;

a ventilation grille defining at least one grille aperture positioned at least partially within the central aperture and configured and arranged to permit airflow through the at least one grille aperture;

the frame further having an outer portion arranged around the inner portion and a base extending between and connecting the inner portion and the outer portion such that the exterior side of the inner portion together with the base and outer portion define a channel surrounding, and adjacent to, the central aperture and wherein the inner portion separates airflow through the grille from the channel;

a plurality of light-emitting diodes on a printed circuit board within the channel; and a cover coupled to the exterior side of the frame and positioned at least partially over at least one of the plurality of light-emitting diodes; and wherein the main housing is configured to be coupled to the interior side of the frame of the illumination grille such that the illumination grille covers at least a portion of the blower assembly.

16. The ventilation assembly of claim 15 wherein the frame and the cover are a single integral component configured and arranged to extend at least partially over at least one of the plurality of light-emitting diodes.

17. The ventilation assembly of claim 15 further comprising a light engine, the light engine comprising a printed circuit board, a power module and at least one plug, wherein the printed circuit board is configured and arranged to mount at least one of the plurality of light-emitting diodes.

18. The ventilation assembly of claim 16 further comprising a light emitting diode light engine, the light emitting diode light engine comprising a printed circuit board, a power module and at least one plug, wherein the printed circuit board is configured and arranged to mount at least one of the plurality of light-emitting diodes.

19. The ventilation assembly of claim 15, the inner portion is comprised of a flat vertical wall.

20. The ventilation assembly of claim 15, wherein the cover is light-transparent.

* * * * *